United States Patent [19]

Kipp

[11] Patent Number: 4,598,614

[45] Date of Patent: Jul. 8, 1986

[54] HAND LEVER TURNING MECHANISM

[75] Inventor: Heinrich Kipp, Sulz-Holzhausen, Fed. Rep. of Germany

[73] Assignee: Heinrich Kipp Werk, Sulz, Fed. Rep. of Germany

[21] Appl. No.: 686,223

[22] Filed: Dec. 26, 1984

[30] Foreign Application Priority Data

Dec. 29, 1983 [DE] Fed. Rep. of Germany ..... 3347433

[51] Int. Cl.[4] ..... B25B 13/06

[52] U.S. Cl. ..... 81/58.3; 81/58.4

[58] Field of Search ..... 81/58, 58.3, 58.4

[56] References Cited

U.S. PATENT DOCUMENTS

| | | | |
|---|---|---|---|
| 2,603,325 | 7/1952 | Pickard | 81/58.3 X |
| 2,607,253 | 8/1952 | Gearhart | 81/58 |
| 4,249,435 | 2/1981 | Villeneuve et al. | 81/58.3 X |

FOREIGN PATENT DOCUMENTS

| | | | |
|---|---|---|---|
| 2526971 | 12/1976 | Fed. Rep. of Germany | 81/58.3 |
| 184416 | 8/1922 | United Kingdom | 81/58.3 |

*Primary Examiner*—Frederick R. Schmidt
*Assistant Examiner*—Debra S. Meislin
*Attorney, Agent, or Firm*—Toren, McGeady, Stanger, Goldberg & Kiel

[57] ABSTRACT

A hand lever mechanism for turning fastening devices particularly for a spindle, axle or the like, wherein a fastening element made of hard material may be rotated by a hand lever made of material softer than the fastening element, with a coupling element affixed to the hand lever and adapted to engage the fastening element to connect the fastening element and the hand lever in rotative engagement being formed of a material harder than the material of the hand lever and being anchored or embedded in the material of the hand lever so as to be rotatable therewith.

1 Claim, 4 Drawing Figures

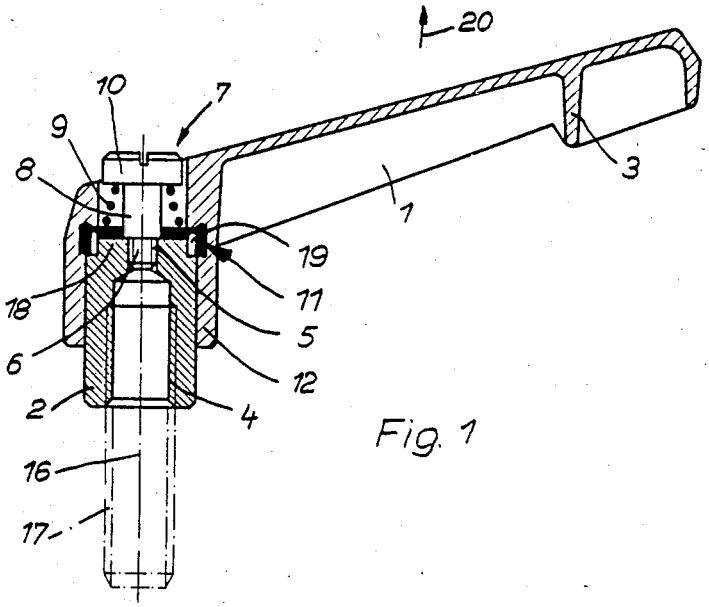
Fig. 1
Fig. 2
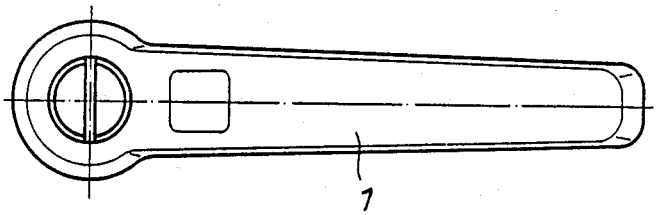
Fig. 3
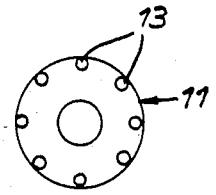
Fig. 4
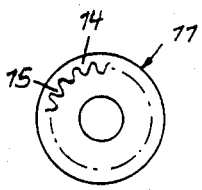

HAND LEVER TURNING MECHANISM

The present invention relates generally to turning mechanisms and more particularly to a hand lever with a fastening element, particularly for a spindle, axle or the like.

More specifically, the invention is directed to a mechanism, wherein the fastening element which is to be rotated by the hand lever is fabricated from a hard material, preferably metal. The hand lever and the fastening element are coupled together axially by means of two coupling elements adapted to engage each other in the longitudinal direction of the lever turning axis.

For hand levers of the type to which the present invention relates, there exists a great variety of areas of application and it is common usage in the application of these devices that the handle of the lever must be brought or returned to a predetermined initial position prior to the commencement of a turning motion or possibly after a certain partial turning has occurred with respect to the spindle, axle or the like. Thus, the turning hand lever must be rotatively engaged and disengaged so that it may be returned to a starting or initial position.

A preferred area of application of devices of this type is with regard to clamping levers as they are utilized in engineering, particularly in combination with machine tools as clamping devices for locking in position blanks which are to be machined on such machine tools.

Hitherto, hand levers of this type have been fabricated from metal. Because of various reasons, it would be preferable to utilize synthetic materials, such as plastics or the like, instead of metals for fabricating the hand lever. In the types of synthetic materials normally used, there is not provided a sufficiently high hardness or load carrying capability as compared with metal. The load carrying capability of a hand lever fabricated from synthetic material is normally lower than that of a metallic hand lever, and, thus, for various reasons, the use of synthetic materials for fastening mechanisms of the type to which the present invention relates cannot be considered.

In view of the foregoing, the present invention is directed toward providing a hand lever mechanism with a fastening element of the type previously mentioned, wherein the hand lever may be fabricated from a different material than the fastening element, and, particularly, from a material which is lighter than metal, and wherein, despite this, the load or torque transmitting capability of the hand lever to the fastening element is not lowered or at least is not significantly reduced than would be the case with a metallic hand lever.

SUMMARY OF THE INVENTION

Briefly, the present invention may be described as a hand lever mechanism for turning a fastening member, particularly for a spindle, axle or the like, comprising a fastening member made of a hard material, a hand lever made of a material softer than said fastening element and adapted to engage said fastening element to effect rotation thereof about a turning axis and a coupling element affixed to said hand lever and adapted to engage said fastening element to connect said fastening element and said hand lever in rotative engagement with each other, said coupling element being made of a material harder than the material of the hand lever and being anchored in the material of the hand lever to be rotatable therewith.

The fastening element is made preferably of metal and the hand lever is preferably manufactured from synthetic material. The coupling element is also made of metal.

Thus, in accordance with the present invention, the hand lever may be manufactured from a material softer than the material of the fastening element and particularly from synthetic material and the coupling element located on the side of the hand lever consists of a hard metal, preferably metal, and may be anchored or embedded in the material of the hand lever in such a way that it will be affixed thereto.

A complementary coupling element may be formed on the fastening element which is adapted to engage with the coupling element on the hand lever and, as a result of the present invention, the coupling element in the hand lever and the complementary coupling element on the fastening element may each consist of a hard material, preferably metal, and, as a result, a relative high value of torque can be transmitted by the mechanism, generally similar to the torque which would be transmitted in a device where the hand lever was also made of metal. The load carrying capability is thus limited only at the nonrotatable connection between the material of the hand lever and the coupling element which is anchored in the hand lever. If the load carrying capability at the joinder of the coupling element and the hand lever can be made to correspond to that in a device where the hand lever is made of metal, then the device of the invention can completely replace an all-metallic mechanism. Furthermore, there will result from the invention significant advantages related to the manufacture thereof from synthetic material, and, in particular, the advantages will involve a mechanism of low weight which can be made at an advantageous cost. Also, surface treatment, such as machining or the like, will be unnecessary in the hand lever.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE DRAWINGS

In the drawings:

FIG. 1 is a sectional view showing a hand lever mechanism with a fastening, element in accordance with the present invention;

FIG. 2 is a top view of a hand lever mechanism of FIG. 1;

FIG. 3 is a top view of a coupling element used in the mechanism of FIG. 1; and FIG. 4 is a bottom view of the coupling element shown in FIG. 3.

DETAILED DESCRIPTION OF THE PREFERRED EMBODIMENT

Referring now to the drawings, wherein similar reference numerals are used to identify like parts in the various figures thereof, there is shown a hand lever mechanism in accordance with the present invention which comprises a hand lever 1 made of material of comparatively low hardness, particularly synthetic material. The hand lever 1 is formed at one end thereof with a sleeve 12 which is adapted to engage over a fastening element 2. The hand lever 1 is formed with a grip part which has a generally U-shaped cross-sectional configuration with the free end thereof, shown at the right in FIG. 1, having somewhat longer U-shaped flanks and reinforced by an intermediate wall 3.

The fastening element, as is particularly shown in FIG. 1, is also formed with an essentially sleeve-like configuration with an internal cavity having female screw threads 4 formed therein. At its upper end, the fastening element 2 is also formed with female screw threads 5. The female screw threads 5 extend over a materially shorter length and about a diameter smaller than the female screw threads 4.

The fastening element 2 is adapted to receive a threaded shank portion 6 of a screw 7. The screw 7 is formed with a nonthreaded shank portion 8 which is surrounded by a conical compression spring 9. The conical compression spring 9 is formed with an upper smaller diameter portion which bears against the underside of a screw head 10 of the screw 7 and with a lower larger diameter end which bears upon the upwardly facing annular surface of a coupling element 11 which is anchored in the hand lever 1.

The coupling element 11, which is shown in greater detail in FIGS. 3 and 4, is made of metallic material and is anchored in the synthetic material of the hand lever 1. FIG. 3 shows the upper side of the coupling element 11 or the side which is embedded or anchored into the synthetic material of the hand lever 11. As indicated in FIG. 3, the coupling element 11 is formed with pins or anchoring elements 13 which are uniformly distributed about the periphery thereof and which serve the purpose of anchoring the coupling element 11 into the synthetic material of the hand lever 1. As will be seen from FIG. 1, the coupling element 11 is inserted into the sleeve 12 of the lever 1.

The opposite or bottom side of the coupling element 11 is shown in greater detail in FIG. 4 and comprises a toothed inner rim 14 having inwardly extending gear teeth 15. The teeth 15 have flanks which extend generally parallel to a turning axis 16 of a spindle 17 or the like which is to be connected with the fastening element 2.

The fastening element 2, with the female thread 4 thereof, is screwed onto the spindle end protruding toward the top.

Formed on the upwardly pointing end of the fastening element 2 is a complementary coupling element 18 which is adapted to be engaged by the coupling element 11. The coupling element 18 is shaped in the form of a pinion and has radially outwardly directed gear teeth 19 which correspond in shape, size and pitch to the teeth 15 of the toothed rim 14 and which are complementary therewith and which are adapted thereby to engage with the teeth 15. The pinion on which the teeth 19 are formed and the toothed rim 14 with the teeth 15 are engaged with each other under the force of the pressure spring 9. Thus, the hand lever 1 and the fastening element 2 are rotatably coupled with each other by engagement of the coupling element 11 and the complementary coupling element 18.

If it is desired to uncouple the mechanism described, the spindle 17 is maintained stationary and the hand lever 1 is pulled upwardly in the direction of the arrow 20. As a result, the spring is compressed and the coupling element 11 is uncoupled from the complementary coupling 18. As a result of this uncoupling, the hand lever 1 may be subsequently turned about the axis 16 with respect to the fastening element 2 by a predetermined angle during which no torque will be transmitted. As soon as the teeth of the two coupling parts 11 and 18 are again in a suitable position relative to each other, coupling may be once again effected and the hand lever 1 may be allowed to drop so that the spring 9 may again hold the coupling element 11 and the complementary coupling element 18 in rotative engagement with each other.

In view of the fact that the fastening element 2 consists of a strong, relatively hard material, which is preferably metal, and since the coupling element 11 embedded in the hand lever 1 is also manufactured from metal, preferably as a pressure die casted part, this toothed coupling engagement is able to transmit relatively large forces. A firm anchoring of the coupling element 11 in the material of the hand lever 1 is achieved as a result of the anchoring elements 13 and an additional or alternative anchoring or coupling could also be achieved by a roughened cylindrical outer periphery or anchoring elements attached thereon.

Thus, it will be seen from the foregoing that the invention comprises a fastening element 2 which is made from hard material, preferably metal, and which can be rotatively affixed with the hand lever 1 which may be made of softer material, preferably synthetic material. The fastening element 2 and the hand lever 1 may be capable of engagement and disengagement through a coupling including the coupling members or elements 11 and 18 and in order to be able to load this rotatable coupling element sufficiently, the coupling element 11 on the side of the hand lever is separately fabricated and anchored in the synthetic material of the hand lever 1. The coupling element 18 on the fastening element is preferably formed integrally or in one piece with the fastening element 2 and the fastening element 2 is connected with a spindle, axle or the like, preferably of a clamping device for clamping a blank in a machine tool. As will be noted from the foregoing, in the development of the invention, the coupling element which is mounted in the hand lever is formed with an annular shape, and preferably as a pressure die casted part which has at the side thereof adjacent the fastening element the engagement elements in the form of gear teeth distributed over its periphery. On the opposite side of the coupling element 11, there are formed the anchoring elements for anchoring the coupling element 11 in the material of the hand lever 1. The shape and size of these parts depend on the material of the hand lever as well as the way in which the coupling element is attached into the material of the hand lever. On the side thereof facing the hand lever, the coupling element 11 may be appropriately sprayed with the synthetic material of the hand lever. In this, obviously, the mating parts of the coupling elements are kept free so that a metal-to-metal coupling contact is clearly possible.

In a further aspect of the invention, the anchoring elements 13 of the coupling element 11 are formed of lugs, projections or similar protruding parts arranged particularly uniformly over the outer periphery. Of course, it should be understood that the lugs or pins 13 need not extend in the radial direction and, rather particularly in the embodiment of the invention described, a protrusion in the axial direction from the annular surface is preferable.

With regard to the coupling members or gear teeth 15 formed on the toothed rim on the underside of the coupling element 11, this toothed rim may also be suitably assigned to the outer area of the annularly shaped coupling element in order to be of a maximum size. Of course, the shape of the teeth 15 is determined in accordance with the corresponding or complementary counter teeth or indentations having equal or similar shapes formed in the fastening element 2. Thus, the teeth of the hand lever, respectively, of the coupling element on the side of the hand lever engage with the teeth of the fastening element.

In view of this, in accordance with a further aspect of the invention, it is provided that the intercoupling counter or complementary connecting members of the complementary coupling element 18 are formed by the teeth of a particularly shaped pinion with outer teeth attached at the inner end of the fastening element, whereby the teeth of the coupling links and the coupling counter links can be coupled and decoupled in the longitudinal direction of the teeth and the coupling is axially spring-loaded in the engaged direction. Because of the spring loading effected by the compression spring 19, the hand lever and the fastening element are always rotatably coupled with each other so that, with a rotative interconnection of the fastening element with a spindle, axle or the like, a turning of the hand lever will also cause a turning of such a spindle or like element. However, if the hand lever must be displaced in the direction of rotation with respect to the momentary position of the spindle or the like, it may be lifted with an immobilized spindle against the resistance, for example, upwardly from the fastening element and turned through an intended turning angle. The toothing system thus allows a stepwise displacement, however, in most applications, this is not a disadvantage.

In accordance with a preferred version of the invention, it is proposed that the loading spring 9 which is designed as a pressure spring intended for coupling the hand lever and the fastening element, on the one hand, bear on the upper side of the coupling element on the side of the hand lever and, on the other hand, on the outer collar of a support link which axially penetrates this coupling element. This support link could, for example, be the screw 7 with the underside of the head of the screw forming the support surface for the pressure spring which is advantageously fashioned as a compression spring. This allows assembly of the unit in a particularly simple manner. For example, by fully compressing the compression spring, it is possible to limit the axial relative movement between the hand lever and the fastening element. In a further development of the invention, it is provided that the fastening element be designed as a sleeve or as a pot-shaped element with a pot-shaped bottom located inside which is supported in a way to be displaceable lengthwise and rotatable in a sleeve-shaped extension 12 of the hand lever. If a screw is used as a support link, a central female screw thread can be provided in the pot bottom for the purpose of screwing in the screw. Most suitably, the screw is provided with threads only over a portion of its shank so that the depth of insertion of the screw can be determined by the length of the threaded part.

While a specific embodiment of the invention has been shown and described in detail to illustrate the application of the inventive principles, it will be understood that the invention may be embodied otherwise without departing from such principles.

What is claimed is:

1. A hand lever mechanism, particularly for turning a member, such as a spindle, axle or the like about an axis, comprising:

a fastening element made of metal adapted to be placed in engagement with a member to be turned;

a hand lever made of synthetic material softer than said fastening element material;

a coupling element formed with an annular configuration consisting essentially of a metallic pressure die cast member having one side affixed to said hand lever and an opposite side engaging said fastening element to connect said fastening element and said hand lever in rotative engagement with each other, the material of said coupling element being selected to be harder than the material of said hand lever, whereby said coupling element is anchored in the material of said hand lever and is rotatable therewith;

coupling members formed on said opposite side of said coupling element and distributed along the periphery thereof, said coupling members being formed on said opposite side of said coupling element facing said fastening element and comprising gear teeth formed as a toothed rim with said gear teeth facing radially inwardly;

anchoring elements comprising projecting elements arranged uniformly along an outer periphery of said coupling element for anchoring said coupling element in the material of said hand lever;

a complementary coupling element formed on said fastening element engaging said coupling members of said coupling element, said complementary coupling element being formed as a pinion having gear teeth radially outwardly directed and shaped to engage with said teeth of said toothed rim of said coupling element, said coupling element and said complementary coupling element being capable of engaging and disengaging by relative movement thereof in the direction of said axis;

spring means acting in the direction of said axis urging said coupling element and said complementary coupling element into rotative engagement with each other; and a screw member threadedly engaged in said fastening element and extending through said coupling element with said spring means being engaged between said screw member and said coupling element;

said fastening element being in the form of a sleeve with said hand lever being formed with an end thereof having a sleeve-like configuration, said fastening element being arranged longitudinally displaceable within said sleeve-like configuration of said one end of said hand lever.

* * * * *

US004598614B1

REEXAMINATION CERTIFICATE (2428th)

United States Patent [19]

Kipp

[11] B1 4,598,614

[45] Certificate Issued Nov. 15, 1994

[54] HAND LEVER TURNING MECHANISM

[75] Inventor: Heinrich Kipp, Sulz-Holzhausen, Germany

[73] Assignee: Monroe Engineering Products, Inc., Bloomfield Hills, Mich.

Reexamination Request:
No. 90/003,424, May 4, 1994

Reexamination Certificate for:

| | |
|---|---|
| Patent No.: | **4,598,614** |
| Issued: | **Jul. 8, 1986** |
| Appl. No.: | **686,223** |
| Filed: | **Dec. 26, 1984** |

[30] Foreign Application Priority Data

Dec. 29, 1993 [DE] Germany ..... 3347433

[51] Int. Cl.[5] ..... B25B 13/06

[52] U.S. Cl. ..... 81/58.3; 81/58.4

[58] Field of Search ..... 81/58, 58.3, 58.4

[56] References Cited

FOREIGN PATENT DOCUMENTS 7618755 10/1972 Germany .
5189965 1/1975 Japan .

*Primary Examiner*—Debra S. Meislin

[57] ABSTRACT

A hand lever mechanism for turning fastening devices particularly for a spindle, axle or the like, wherein a fastening element made of hard material may be rotated by a hand lever made of material softer than the fastening element, with a coupling element affixed to the hand lever and adapted to engage the fastening element to connect the fastening element and the hand lever in rotative engagement being formed of a material harder than the material of the hand lever and being anchored or embedded in the material of the hand lever so as to be rotatable therewith.

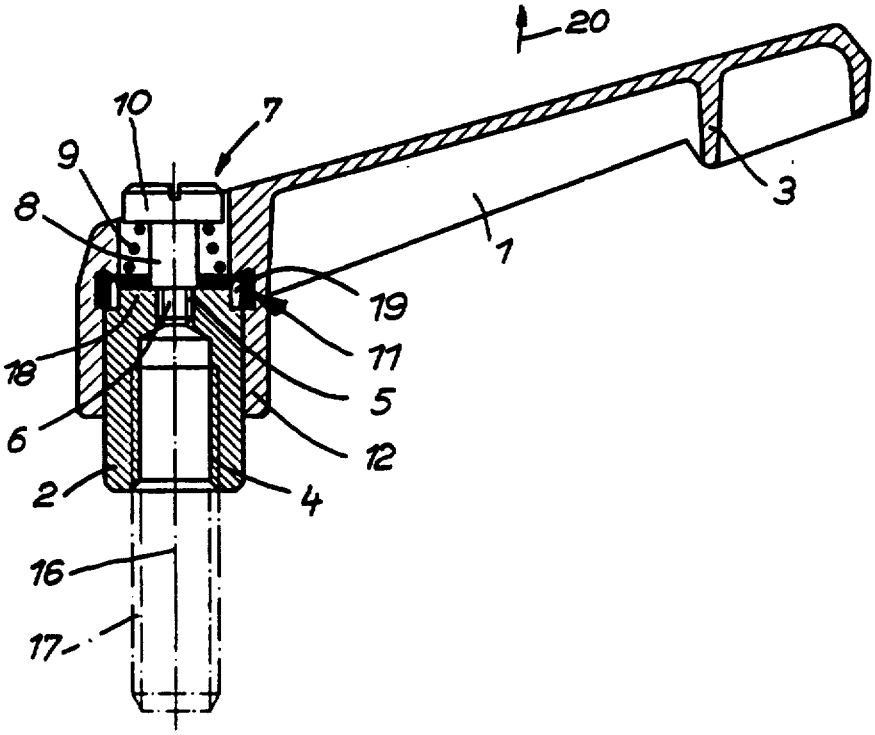

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *